US007469566B2

(12) United States Patent
Heimann

(10) Patent No.: US 7,469,566 B2
(45) Date of Patent: Dec. 30, 2008

(54) ROLL STAND

(75) Inventor: Bernhard Heimann, Moers (DE)

(73) Assignee: SMS Meer GmbH, Monchengladbach (DE)

( * ) Notice: Subject to any disclaimer, the term of this patent is extended or adjusted under 35 U.S.C. 154(b) by 0 days.

(21) Appl. No.: 11/788,592

(22) Filed: Apr. 20, 2007

(65) Prior Publication Data

US 2007/0251284 A1 Nov. 1, 2007

(30) Foreign Application Priority Data

Apr. 27, 2006 (DE) ..... 10 2006 019 514

(51) Int. Cl.
*B21B 31/00* (2006.01)

(52) U.S. Cl. ..... 72/237

(58) Field of Classification Search ..... 72/237, 72/238, 239

See application file for complete search history.

(56) References Cited

U.S. PATENT DOCUMENTS 5,450,740 A * 9/1995 Lovinggood et al. ..... 72/182
2002/0134127 A1* 9/2002 Takeda et al. ..... 72/239
2007/0187065 A1 8/2007 Marti ..... 164/476

FOREIGN PATENT DOCUMENTS

| | | |
|---|---|---|
| DE | 3912684 | 10/1990 |
| EP | 0 388 865 | 9/1990 |
| EP | 1184095 | 3/2002 |
| GB | 1210738 | 10/1970 |
| WO | WO-2005/018843 | 3/2005 |

* cited by examiner

*Primary Examiner*—Dana Ross
*Assistant Examiner*—Debra M Sullivan
(74) *Attorney, Agent, or Firm*—Andrew Wilford

(57) ABSTRACT

One of a pair of rolls of a roll stand is formed with an axially throughgoing central hole through which passes a drive shaft having a pair of ends. A coupling at one end of the drive shaft rotates same and the one roll. This one roll can be shifted, normally vertically, between a use position closely juxtaposed with the other roll and a change position spaced away from the other roll and with the roll resting on supports. An entrainment fitting on the carriage can fit with and axially connect to an entrainment element of the drive shaft in the change position of the other roll. An actuator can shift the carriage from an inner position into an outer position and thereby pull the drive shaft out of the one roll and leave the one roll resting on the supports.

11 Claims, 4 Drawing Sheets

ROLL STAND

FIELD OF THE INVENTION

The present invention relates to a roll stand. More particularly this invention concerns a roll stand used in a rolling mill.

BACKGROUND OF THE INVENTION

A roll stand has a pair of working rolls at least one of which during normal use is carried on a roll shaft that passes through a central hole in the one roll. One axial end of the roll shaft is detachably connected to a drive shaft via a coupling. A roll-changing device is associated with the roll stand.

It is known to change rolls in a standard roll stand according to the following procedure: The roll, together with associated parts, namely the roll shaft and the end mounts, is removed from the frame of its roll stand in order to exchange or replace the roll at a location at some distance from the rolling line.

Usually an end mount is pulled off the roll and gotten out of the way, then the roll is pulled axially off its shaft. Another roll is slid onto the shaft, and the end mount, normally comprised of a bearing around a stub end of the shaft and a block in which an outer race of the bearing is set, is reinstalled. Offline roll-changing devices are often used to assist in changing the roll. After the roll has been switched, the entire unit is then reinstalled in the forming machine.

Changing the rolls in a standard roll stand requires a considerable amount of time, during which the machine is not available. This is associated with an economic loss. The changing procedure also involves substantial effort in handling.

OBJECTS OF THE INVENTION

It is therefore an object of the present invention to provide an improved roll stand.

Another object is the provision of such an improved roll stand that overcomes the above-given disadvantages, in particular that allows for less complicated and thus quicker roll changing.

The object is thus to reduce the down time for the stand during roll changing.

A further object is to reduce the handling effort during roll changing.

SUMMARY OF THE INVENTION

A roll stand has according to the inventions support frame and a pair of rolls carried on the frame and centered on and rotatable about respective roll axes, one of the rolls being formed with an axially throughgoing central hole through which passes a drive shaft having a pair of ends and in torque-transmitting engagement with the one roll. A rotatable coupling is engageable with one end of the drive shaft for rotating same and the one roll. An entrainment element is carried on the other end of the drive shaft, and supports are provided on the frame below the one roll. This one roll can be shifted, normally vertically, between a use position closely juxtaposed with the other roll and a change position spaced away from the other roll and with the roll resting on the supports. A roll-stripping carriage can move at the other end of the roll axially of the roll between an inner position close to the one roll and an outer position spaced away axially from the other roll. An entrainment fitting on the carriage can fit with and axially connect to the entrainment element of the drive shaft in the change position of the other roll. An actuator, when the entrainment fitting is engaged with the entrainment element in the change position of the one roll and the roll is resting on the supports, can shift the carriage from the inner position into the outer position and thereby pull the drive shaft out of the one roll and leave the one roll resting on the supports.

Thus according to the invention the roll-changing device is an integral component of the roll stand. It is thus possible to change rolls without having to remove a large number of parts from the roll stand during the exchange.

In accordance with the invention the entrainment fitting situated on the extraction carriage is designed as a metal plate having a slotted or U-shaped seat, and that the entrainment element is designed as a shaft having an annular groove, the clearance of the annular groove in the base of the groove being slightly smaller than the width of the slot or U-shaped recess in the entrainment element. This enables a particularly simple and secure coupling of the roll shaft to the extraction carriage. In fact, when the seat is open upward, the entrainment element and entrainment fitting are automatically coupled together when the lower roll is dropped into a lower change position.

The roll-changing device may also have a coupling support for receiving the coupling, so that the coupling is held in an axially nondisplaceable, preferably stationary, manner.

The roll-changing device may also have two roll supports situated in the axial end regions of the roll and engageable with the standard stub shafts of the roll. These roll supports are provided with surfaces on which the roll may be placed for pulling from the roll shaft. The roll supports may be fixed to the base frame of the roll stand.

The extraction carriage may have a holder for one of the roll end mounts in order to move the end mount during the axial displacement of the extraction carriage.

The extraction carriage may be displaceable in the horizontal direction, relative to the roll stand by an actuator.

A hydraulic piston-cylinder system is usually used as an actuator.

The extraction carriage may also have a guide which can establish a solid connection between the extraction carriage and one of the end mounts for the roll. The guide preferably has a vertically extending abutment face for the end mount. By means of the vertical guide the end mount is connected to the extraction carriage so as to be horizontally movable, so that the end mount must absorb only the tilting forces or torques of the roll shaft, but not the withdrawal forces during insertion and withdrawal of the roll shaft.

The proposed design of a roll stand allows the roll change to be carried out directly in the forming machine, i.e. in the rolling line. This may be performed efficiently by use of the integrated roll-changing device.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
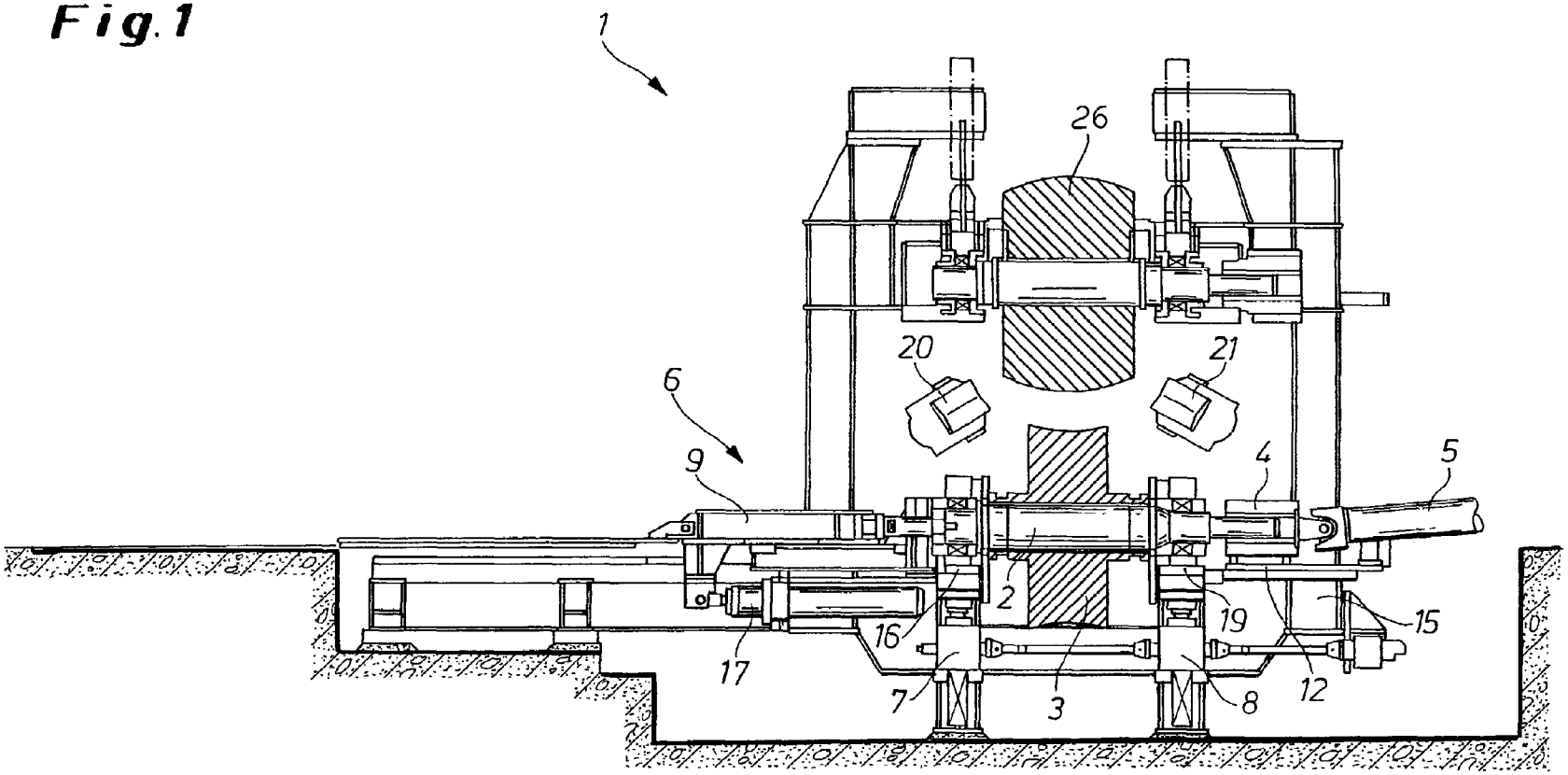
FIG. 1 is an end view partly in cross section through a roll stand according to the invention.

As seen in FIG. 1 a roll stand 1 is shown in which by multiple passes a metal strip (not illustrated) is rolled into a tubular body which is then welded to a pipe. It has a frame 15 carrying a lower roll 3 centered on an axis 3A and lateral roll beams 20 and 21. The roll 3 to be considered in greater detail is supported on and rotationally coupled via unillustrated splines or a key 28 to a coaxial roll shaft 2 passing through a central hole in the roll 3. The roll 3 is driven via a drive shaft 5 which is designed as an articulated shaft and connected to the roll shaft 2 via a coupling 4.

Figure 2A:
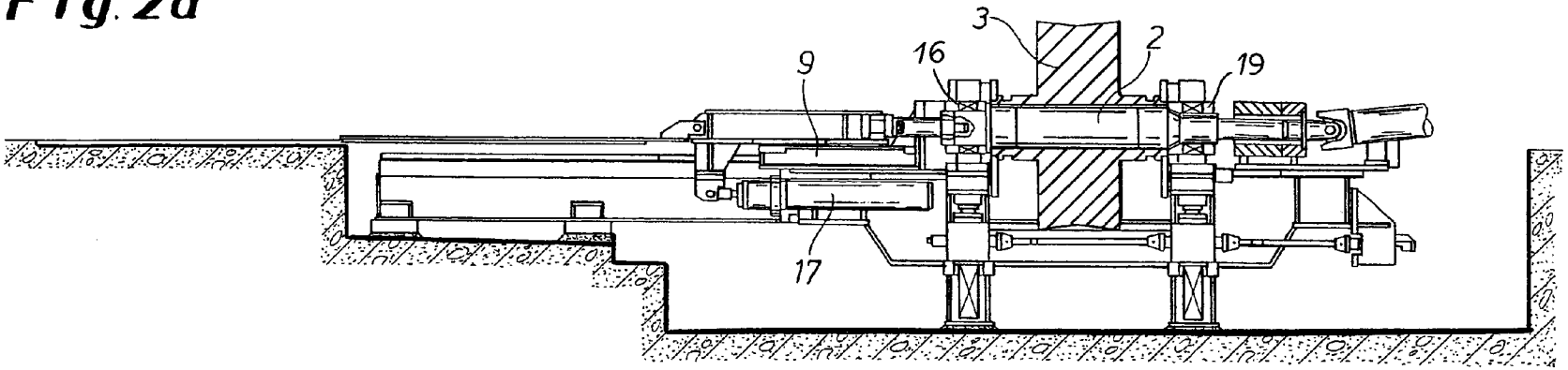
FIGS. 2*a* and 2*b* are views like the lower part of FIG. 1 but showing the roll-changing system in the inner roll-engaging position and the outer roll-extracting position, respectively.
Figure 2B:
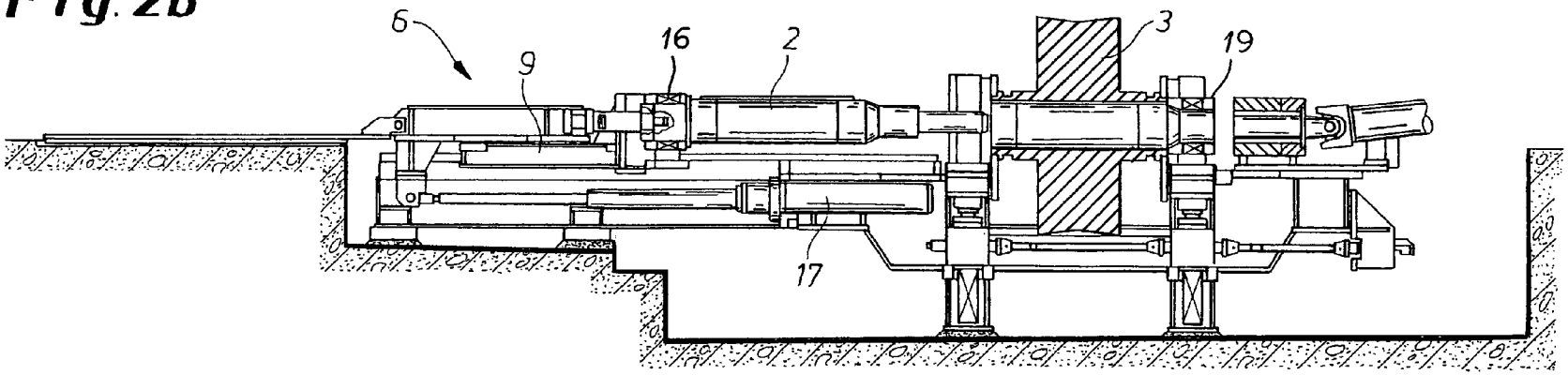

To change the roll 3, a roll-changing device 6 is provided that is described in greater detail below. A significant feature is that the roll-changing device 6 is integrated into the roll stand 1. This roll-changing device 6 has an extraction carriage 9 that is movable horizontally and in the direction of the axis 3A of the roll 3 or the roll shaft 2. For this purpose an actuator 17 is provided, constituted as a hydraulic piston-cylinder unit. The carriage 9 can be moved from an inner position (FIG. 2*a*) to an outer position (FIG. 2*b*) and back by the actuator 17.

Figure 3:
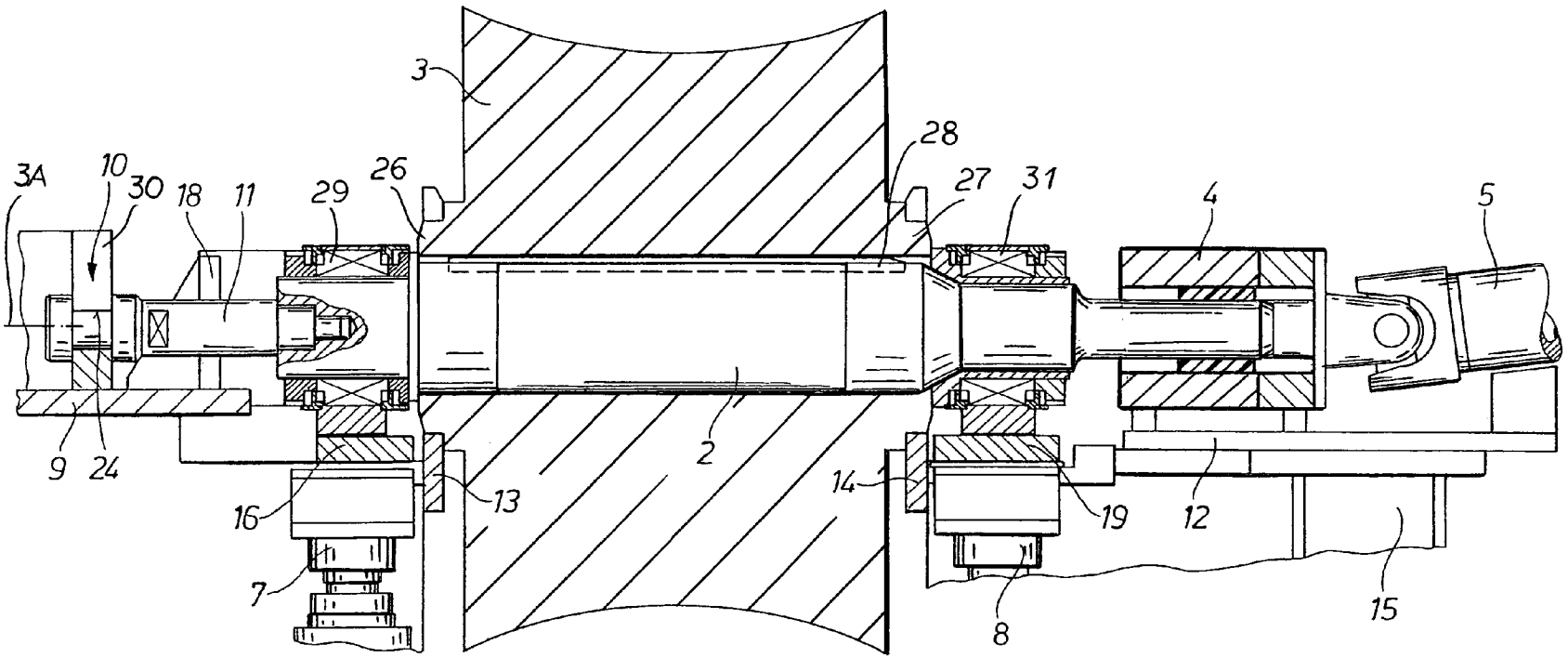
FIG. 3 is a large-scale view of a detail of FIG. 2*a*.

The roll 3 together with the roll shaft 2 are initially in an upper working position (not illustrated) in which they are held by two lower roll positioners 7 and 8, with the unillustrated strip workpiece pressed by the roller 2 against an upper roll 26. The lower roll positioners 7 and 8 may at the same time be used as means for lowering or raising the roll 3 for roll changing. In FIGS. 2 and 3 the roll 3 and the roll shaft 2 are in a lowered position which is assumed for roll changing. The roll 3 is supported at its end stubs 26 and 27 on two roll supports 13 and 14 which hold the roll in a roll changing position.

For roll changing, the roll 3 is thus moved into a lower change position which is not the working position. Roll end mounts 16 and 19 are axially fixed in the working position by means of a bayonet, for example, and in the change position are released, i.e., the bayonet lock is unlocked. In the illustrated embodiment the roll 3 is moved downward for changing. If this system were applied to the upper roll 26 directions would be appropriately changed.

On the left side of FIG. 3 an entrainment element 11 is shown which is fixedly connected to the roll shaft 2. The entrainment element 11 is designed as a shaft-like extension that is fixed to the end of the shaft 2 and that in a left axial end region has a coupling recess 24 in the shape of an annular groove (see FIG. 3). An entrainment element or fitting 10 provided on the extraction carriage 9 in the present case is a metal plate welded onto the extraction carriage 9. A slot 30 or, viewed from the side, a U-shaped seat is provided in the metal plate forming the entrainment fitting 10. The clearance of the slot 30 is only slightly larger than the clearance of the annular groove 24. This slot 30 opens upward.

As a result, when the roll 3 together with the roll shaft 2 are lowered by the positioners 7 and 8, the entrainment element ll drops with its annular groove, 24 into the slot 30 in the entrainment fitting 10. In this manner the entrainment element 11 and the roll shaft 2 fixed axially to it are connected to the extraction carriage 9 so as to be nondisplaceable in the direction of the axis 3A of the roll shaft 2 relative to each other.

Simultaneous with the lowering of the roll shaft 2, the roll shaft coupling 4 is set on a coupling support 12 which is fixed to the base frame 15 of the roll stand 1. As described above, the roll 3 is resting meanwhile via its stubs 26 and 27 on the roll supports 13 and 14. The left-end mount 16 for the roll 3 is connected to the extraction carriage 9 via a vertically extending guide 18 in order to hold the roll shaft 2 horizontal. The guide 18 can move limitedly axially relative to the entrainment fitting 10. This ensures that the extraction force is transmitted directly to the roll shaft 2 and not through the end mount 16. By means of the vertical guide 18 the end mount 16 is connected to the extraction carriage 9 so as to be horizontally movable, so that the end mount 16 only has to absorb the tilting forces resulting from the intrinsic weight of the roll shaft 2, but not the withdrawal forces during insertion and withdrawal of the roll shaft 2, as described below.

Since the coupling 4 is situated on the coupling support 12 so as to be nondisplaceable in the direction of the axis of the roll shaft 2, when the actuator 17 is actuated the roll shaft 2 can be pulled from the hole in the roll 3 in the axial direction and out of the coupling 4, to which it may be connected via splines or a key. The elements thus move from the position illustrated in FIG. 2*a* to that illustrated in FIG. 2*b*. The roll 3 is thus exposed so that it may be switched. The right-end mount 19 remains in the illustrated position (see FIGS. 2*b* and 3). The left end mount 16 and the roll shaft 2 remain one unit.

Figure 4B:
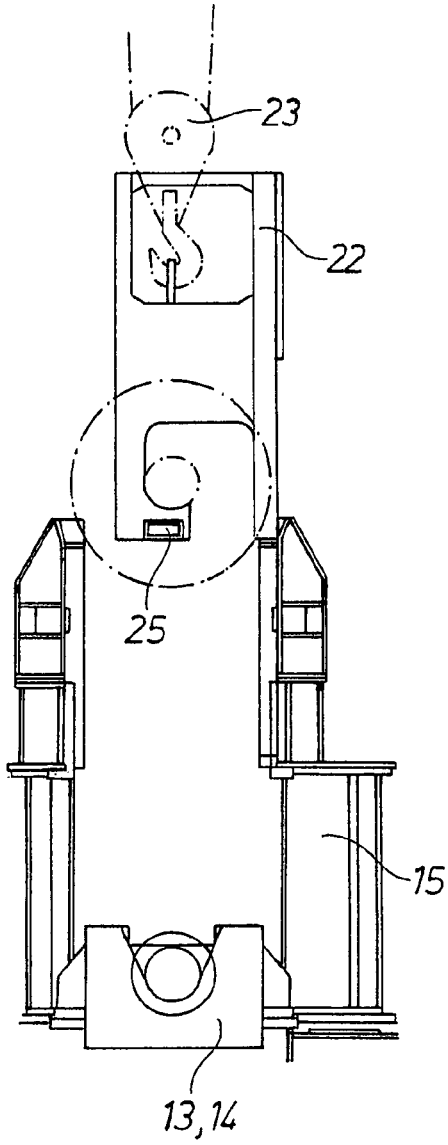
FIGS. 4*a* and 4*b* art side views illustrating removal of the roll once its shaft has been pulled.
Figure 4A:
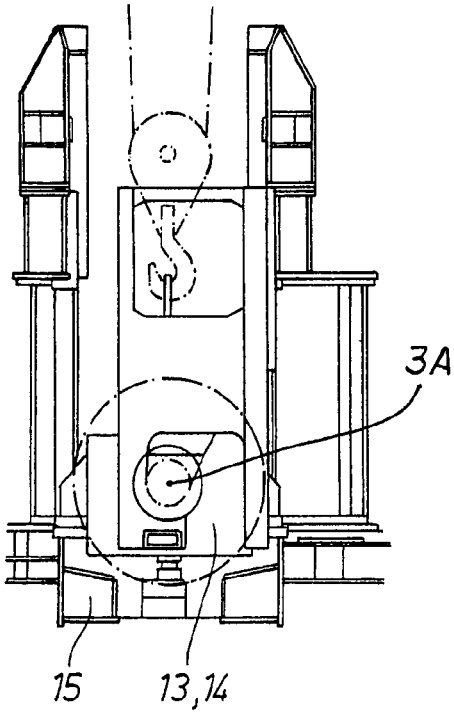

FIGS. 4*a* and 4*b* show the manner in which the roll 3 can be changed after the roll shaft 2 is pulled from the roll 3. A crane 23 carries a roll-transport and -insertion device 22 whose grab 25 can engage under and raise the roll 3. In this manner the roll 3 is lifted from the roll stand 1, and another roll is inserted in the stand and fitted on the roll supports 13 and 14.

A fresh roll is fixed in place in the roll stand in the reverse sequence as for disassembly. Thus the roll shaft 2 is first inserted through the hole in the roll 3 and into the end mount 19. By means of the roll positioners 7 and 8 the fresh roll can then be moved directly into the working position.

Thus, the roll-changing device is designed in such a way that the withdrawal forces from pulling out the roll shaft 2 act directly on the roll shaft 2 via the entrainment element 11 (coupling bolt). This has the advantage that roller bearings 29 and 31 in the end mounts 16 and 19 are not subjected to stress during roll changing, and are thus protected from damage.

I claim:

1. A roll stand comprising:

a support frame;

a pair of rolls carried on the frame and centered on and rotatable about respective roll axes, one of the rolls being formed with an axially throughgoing central hole;

a drive shaft having a pair of ends and fittable through the hole in torque-transmitting engagement with the one roll;

drive means including a rotatable coupling engageable with one end of the drive shaft for rotating same and the one roll;

an entrainment element carried on the other end of the drive shaft;

supports on the frame below the one roll;

means for shifting the one roll between a use position closely juxtaposed with the other roll and a change position spaced away from the other roll and with the roll resting on the supports;

a roll-stripping carriage shiftable at the other end of the drive shaft axially of the one roll between an inner position close to the one roll and an outer position spaced away axially from the one roll;

an entrainment fitting on the carriage fittable and axially couplable with the entrainment element of the drive shaft in the change position of the one roll;

actuator means for, when the entrainment fitting is engaged with the entrainment element in the change position of the one roll and the one roll is resting on the supports, shifting the carriage from the inner position into the outer position and thereby pulling the drive shaft out of the one roll and leaving the one roll resting on the supports;

an end mount on the one end of the shaft and mounted permanently on the frame such that the one end can slide into and out of the end mount;

another end mount mounted permanently on the other end of the shaft;

bearings in both end mounts rotatably supporting the drive shaft; and a support on the carriage on which the other end mount rests in the change position of the one roll.

2. The roll stand defined in claim 1 wherein the support of the carriage can move limitedly axially on the carriage relative to the fitting, whereby traction exerted on the fitting by movement of the carriage is not applied to the end mount on the carriage support.

3. The roll stand defined in claim 1 wherein the entrainment element and the fitting have complementary and radially extending formations that fit together when the one roll is moved into the change position in the inner position of the carriage.

4. The roll stand defined in claim 3 wherein the formation of the entrainment element is a radially outwardly open groove and the formation of the fitting is a U-shaped seat in a plate.

5. The roll stand defined in claim 4 wherein the seat is open upward and the change position is below the use position.

6. The roll stand defined in claim 1, further comprising a coupling support on the frame engaging and supporting the coupling in the change position of the one roll.

7. The roll stand defined in claim 1 wherein the roll has end stubs resting on the supports in the change position.

8. The roll stand defined in claim 7 wherein the supports are fixed on the frame.

9. The roll stand defined in claim 1 wherein the shaft has on its other end an end mount and the carriage is provided with a guide fittable complementarily with the end mount.

10. The roll stand defined in claim 9 wherein the guide has a vertically extending abutment face engageable with the end mount.

11. A roll stand comprising:

a support frame;

a pair of rolls carried on the frame and centered on and rotatable about respective roll axes, one of the rolls being formed with an axially throughgoing central hole;

a drive shaft having a pair of ends and fittable through the hole in torque-transmitting engagement with the one roll;

drive means including a rotatable coupling engageable with one end of the drive shaft for rotating same and the one roll;

an entrainment element carried on the other end of the drive shaft;

supports on the frame below the one roll;

means for shifting the one roll between a use position closely juxtaposed with the other roll and a change position spaced away from the other roll and with the one roll resting on the supports;

an end mount on the other end of the drive shaft;

a roll-stripping carriage shiftable at the other end of the drive shaft axially of the roll between an inner position close to the one roll and an outer position spaced away axially from the one roll;

a guide on the carriage fittable complementarily with the end mount;

an entrainment fitting on the carriage fittable and axially couplable with the entrainment element of the drive shaft in the change position of the one roll; and actuator means for, when the entrainment fitting is engaged with the entrainment element in the change position of the one roll and the one roll is resting on the supports, shifting the carriage from the inner position into the outer position and thereby pulling the drive shaft out of the one roll and leaving the one roll resting on the supports.

* * * * *